US011286705B1

(12) United States Patent
Matsushita

(10) Patent No.: US 11,286,705 B1
(45) Date of Patent: Mar. 29, 2022

(54) CABLE GUIDE ASSEMBLY FOR A WINDOW REGULATOR

(71) Applicant: HI-LEX CONTROLS, INC., Rochester Hills, MI (US)

(72) Inventor: Masayuki Matsushita, Schweinfurt (DE)

(73) Assignee: HI-LEX CONTROLS, INC., Rochester Hills, MI (US)

( * ) Notice: Subject to any disclaimer, the term of this patent is extended or adjusted under 35 U.S.C. 154(b) by 0 days.

(21) Appl. No.: 17/081,284

(22) Filed: Oct. 27, 2020

(51) Int. Cl.
*E05F 11/48* (2006.01)
*E05F 15/689* (2015.01)
*E05D 15/16* (2006.01)

(52) U.S. Cl.
CPC ..... *E05F 15/689* (2015.01); *E05D 15/165* (2013.01); *E05F 11/488* (2013.01); *E05Y 2201/654* (2013.01); *E05Y 2201/66* (2013.01); *E05Y 2201/668* (2013.01); *E05Y 2201/684* (2013.01); *E05Y 2600/10* (2013.01)

(58) Field of Classification Search
CPC .... E05F 15/689; E05F 11/488; E05D 15/165; E05Y 2201/684; E05Y 2201/66; E05Y 2201/668; E05Y 2600/10
USPC ..... 49/352
See application file for complete search history.

(56) References Cited

U.S. PATENT DOCUMENTS 5,074,077 A 12/1991 Toyoshima et al.
5,778,600 A * 7/1998 Chu ..... E05F 11/485 49/349
6,151,833 A * 11/2000 Gmurowski ..... E05F 11/483 49/352
6,227,993 B1 * 5/2001 Medebach ..... E05F 11/382 474/144
7,882,658 B2 * 2/2011 Staser ..... E05F 11/483 49/352
7,958,676 B2 * 6/2011 Kruger ..... E05F 11/483 49/352
9,151,102 B2 * 10/2015 Debus ..... E05F 7/00
9,511,652 B2 * 12/2016 Barr ..... B60J 5/0416
9,580,953 B1 * 2/2017 Matsushita ..... B60J 1/08
9,896,874 B2 * 2/2018 Chono ..... E05F 15/689
10,309,140 B2 * 6/2019 Imaoka ..... E05F 11/48
10,526,832 B2 1/2020 Gruca et al.
10,711,502 B2 * 7/2020 Yokoyama ..... E05F 11/48
(Continued)

FOREIGN PATENT DOCUMENTS

DE 102005041636 A1 3/2007
EP 1243733 A1 9/2002

*Primary Examiner* — Jerry E Redman
(74) *Attorney, Agent, or Firm* — Dickinson Wright PLLC

(57) ABSTRACT

A cable guide assembly adapted for use with a guide rail for a motor vehicle, for redirecting a cable of a window regulator, includes a cable guide formed with an arc-shaped body having a cable guide groove on an outer perimeter of the arc-shaped body and a cable guide receiving site formed in the guide rail adapted to receive and mount the cable guide. The cable guide includes a cable holding tab extending outward from the arc-shaped body along a longitudinal axis and a pair of side hooks extending from an end portion of the arc-shaped body along a transverse axis. In an intermediate-installed state of the cable, the cable is set under the cable holding tab, and in a fully-installed state of the cable, the side hooks are configured to prevent the cable from coming off from the cable guide.

12 Claims, 4 Drawing Sheets

(56) References Cited

U.S. PATENT DOCUMENTS

| | | | | |
|---|---|---|---|---|
| 2006/0174542 | A1* | 8/2006 | Bernard | E05F 11/485 49/352 |
| 2006/0179720 | A1* | 8/2006 | Vantrease | E05B 79/20 49/352 |
| 2008/0222962 | A1 | 9/2008 | Staser et al. | |
| 2015/0101252 | A1* | 4/2015 | Baba | E05F 15/689 49/349 |
| 2020/0102778 | A1 | 4/2020 | Eisentraudt | |

* cited by examiner

CABLE GUIDE ASSEMBLY FOR A WINDOW REGULATOR

TECHNICAL FIELD

This present disclosure relates to a cable guide assembly for a window regulator potentially suited for various application but in a preferred implementation is utilized in an automotive window regulator assembly.

BACKGROUND

The statements in this section merely provide background information related to the present disclosure and may not constitute prior art.

Motor vehicles such as a passenger car and a light truck feature a movable glass in each side door. The mechanism of the movable glass is required to move the glass between the upper closed position and the lower opened position. These mechanisms are generally known as window regulators. Window regulators can be manually operated, or can be driven by a power actuator, most commonly employing an electric motor. One type of window regulator uses pulley assemblies and/or cable guides redirecting a metal cable wrapped around a drum driven by an electric motor. These devices use carriers movable along guide rails which engage the door glass which is a driven by the metal cable to control its motion.

The cable guides and/or pulley assemblies provided for cable driven window regulator systems are available in numerous configurations. Generally, the pulley assemblies attached or coupled to the guide rail on a module plate are provided to rotate about an axis of rotation for changing a direction of the metal cable. Various fastening elements such as screws or stepped pins are used for rotatable attachments, which are guided centrally through the cable pulley assemblies.

As described above, the fastening elements such as the stepped pins and washers are used for supporting forces on the cable pulley. We have discovered, however, that the pulley assemblies or cable guides having the fastening elements will take more manufacturing steps for the assembly of the window regulator. Accordingly, there is constantly a desire to simplify the assembled components and steps of the pulley assemblies or cable guides. In addition, there is more desire to reduce cost and weight of automotive components, while providing a desirable durability, low warranty claims, and compliance with performance requirements.

SUMMARY

The present disclosure relates to a cable guide assembly utilized in an automotive window regulator assembly. In particular, the present disclosure relates to the cable guide fixedly mounted to a guide rail generally attached to the integrated door module plate.

According to an aspect of the present disclosure, the cable guide assembly adapted for use with a guide rail for a motor vehicle, for redirecting a cable of a window regulator includes a cable guide formed with an arc-shaped body having a cable guide groove on an outer perimeter of the arc-shaped body and mounted to the guide rail, and a cable guide receiving site formed to the guide rail adapted to receive and mount the cable guide. The cable guide includes a pair of side hooks and a cable holding tab. The cable holding tab extends outward from a middle section of the arc-shaped body along a longitudinal axis of the guide rail and the cable is set under the cable holding tab defined in an intermediate-installed state of the cable, and each of the side hooks extends from an end portion of the arc-shaped body along a transverse axis of the guide rail relative to the longitudinal axis and is configured to prevent the cable from coming off from the cable guide in a fully-installed state of the cable where the cable is set to tension in the cable guide.

According to a further aspect of the present disclosure, each of the side hooks is formed with a L-shaped body, which includes a lower portion extending from the cable guide along the transverse axis and an upper portion upwardly angled from the lower portion in a vertical axis of the guide rail. The upper portion is formed with a fin-shaped plane parallel to a XZ-plane of the guide rail, and the fin-shaped plane includes a sloped-edge in a front side of the fin-shaped plane and a vertical-edge with a recess in a rear side of the fin-shaped plane. The cable set under the cable holding tab in the intermediate-installed state of the cable sits on the sloped edge of the fin-shaped plane and is slid to move inside the cable guide groove such that the cable is set to tension inside the cable guide groove in the fully-installed state of the cable. The side hooks of the cable guide are configured to prevent the tensioned cable in the fully-installed state from coming off from the cable guide groove.

According to a further aspect of the present disclosure, the cable guide receiving site includes a cable guide interface formed with a cable guide retention tab for securing the cable guide. The cable guide includes a pair of retention members having a first end attached to an upper flange of the cable guide, and a second end extending from the first end along the longitudinal axis and being engaged with the cable guide retention tab.

According to a further aspect of the present disclosure, the cable guide receiving site includes a guiding channel formed on the guide rail along the longitudinal axis of the guide rail. The cable guide includes a protrusion formed on a bottom surface of the arc-shaped body for slidably engaging with the guide channel when the cable guide is securely mounted to the cable guide receiving site defined as a pre-installed state of the cable.

According to a further aspect of the present disclosure, the cable guide includes an upper flange and a lower flange, and the cable guide groove formed on the outer perimeter of the arc-shaped body is located between the upper flange and the lower flange. A lower portion of the L-shaped side hook extends from the lower flange of the arc-shaped body along the transverse axis, and the cable holding tab extends from the upper flange of the arc-shaped body along the longitudinal axis.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

In order that the disclosure may be well understood, there will now be described various forms thereof, given by way of example, reference being made to the accompanying drawings, in which.

Figure 1:
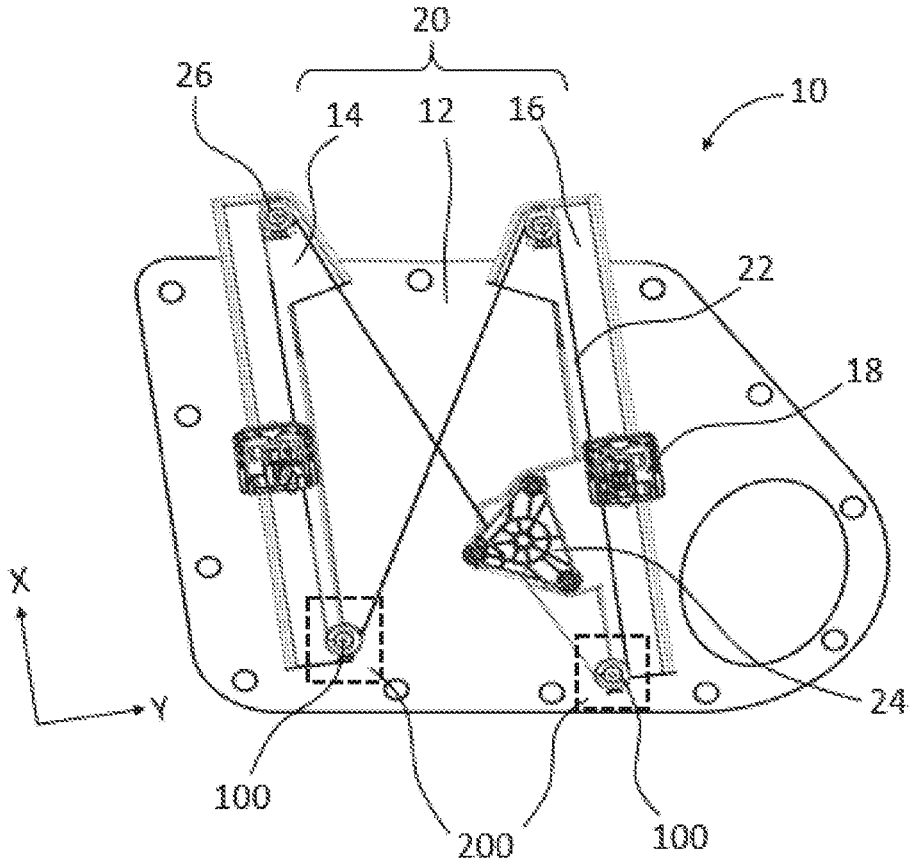
FIG. 1 is a plan view of a cable guide assembly in a window regulator in accordance with a form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

FIG. 1 illustrates a window regulator assembly 10 in a motor vehicle. The window regulator assembly 10 generally includes a door module plate 12, and first and second guide rails 14 and 16, which are oriented parallel to each other. On the window regulator assembly 10, both guide rails 14 and 16 extend from a lower end to an upper end slightly inclined, which is defined as a longitudinal axis X, i.e., in an assembled condition, both guide rails 14 and 16 are slightly inclined along the longitudinal axis X of the guide rails 14 and 16. In addition, the guide rails 14 and 16 extend and hang over a top edge of the door module plate 12 as shown in FIG. 1.

In FIG. 1, the first and second guide rails 14 and 16 are used as a guide for the movement of a window between an open position and a closed position. Both guide rails 14 and 16 are generally separately attached to the door module plate 12 as found in a conventional window regulator assembly. As shown in FIG. 1, in another approach, the first and second guide rails 14 and 16 are preferably integrally formed together with the door module plate 12 as a single unit such that an integrated door module plate 20 formed with the first and second guide rails 14 and 16 is made from a thermoplastic material in order to reduce its weight, and to simplify integration with and provide support for other components in the window regulator assembly 10.

The window regulator assembly 10 further includes window carriers 18, a cable 22, and a drive unit 24. Each of the window carriers 18 is engaged with each of the first and second guide rails 14 and 16, and caused to travel up and down along the guide rails 14 and 16. In addition, the window carriers 18 include a window clamp arrangement (not shown) which is engaged with a window. Each of the window carriers 18 is attached or connected to the cable 22, and such arrangements or connections may be made by clamps, fasteners, adhesives, press-fitting, snap-fitting, or any other means.

In FIG. 1, the drive unit 24 is manually operated via a hand crank mechanism or powered, most commonly done using an electric motor attached to a set of gears, such as worm and spur gears (not shown). The drive unit 24 interacts with the cable 22 to provide the cable tension necessary to cause the window carriers 18 and the window (not shown) to move between its open and closed positions. Furthermore, the drive unit 24 is attached to the integrated door module plate 20.

Referring to FIG. 1, each of the guide rails 14 and 16 includes pulley assemblies 26 coupled to the upper end of the guide rails 14 and 16. In addition, cable guides 100 are engaged with the lower end of the guide rails 14 and 16. For example, as shown in FIG. 1, at least two cable guides 100 are coupled to the guide rails 14 and 16 in the integrated door module plate 20 for guiding the cable 22. In FIG. 1, the guide rails 14 and 16 in the integrated door module plate 20 are formed with at least two cable guide receiving sites 200 each receiving the cable guides 100 respectively. The pulley assemblies 26 and cable guides 100 in the window regulator assembly 10 serve as redirecting elements for the cable 22 such that a driving force transmitted via the cable 22 is redirected via the pulley assemblies 26 and the cable guides 100. The pulley assemblies 26 mounted to the integrated door module plate 20 are freely rotated during the operation of the window regulator assembly 10, but according to the present disclosure, the cable guides 100 are non-rotatably fixed to the guide rails 14 and 16 of the integrated door module plate 20 during the process of the window regulator assembly 10. Accordingly, the window engaged with the window carriers 18 are operated, i.e., raised and lowered by the window regulator assembly 10.

Figure 2A:
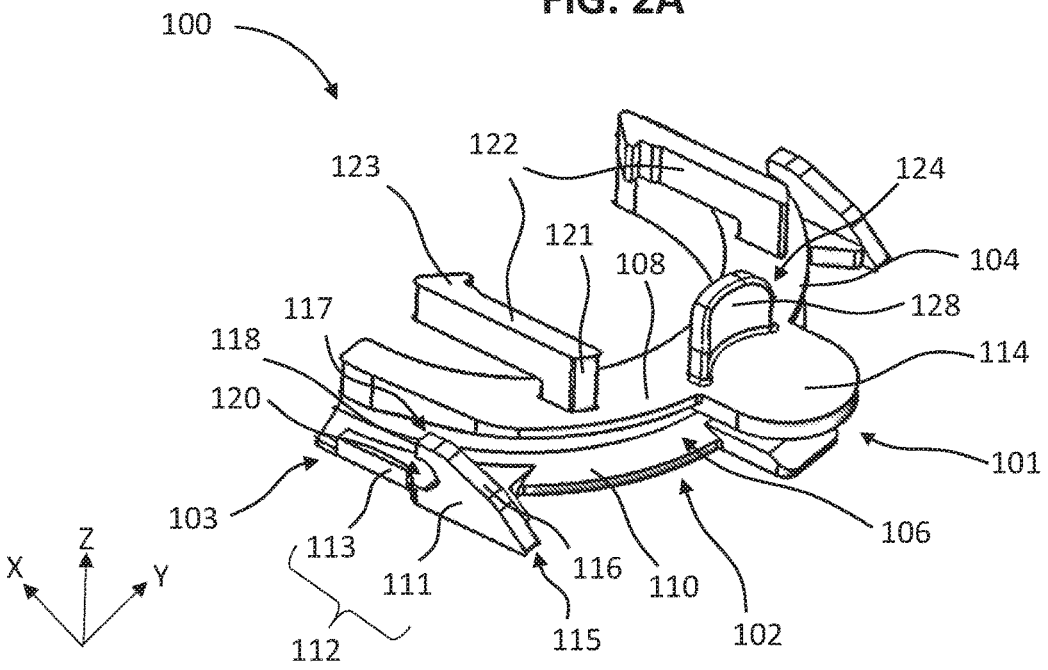
FIG. 2A shows a perspective view of a top surface in a cable guide of FIG. 1.
Figure 2B:
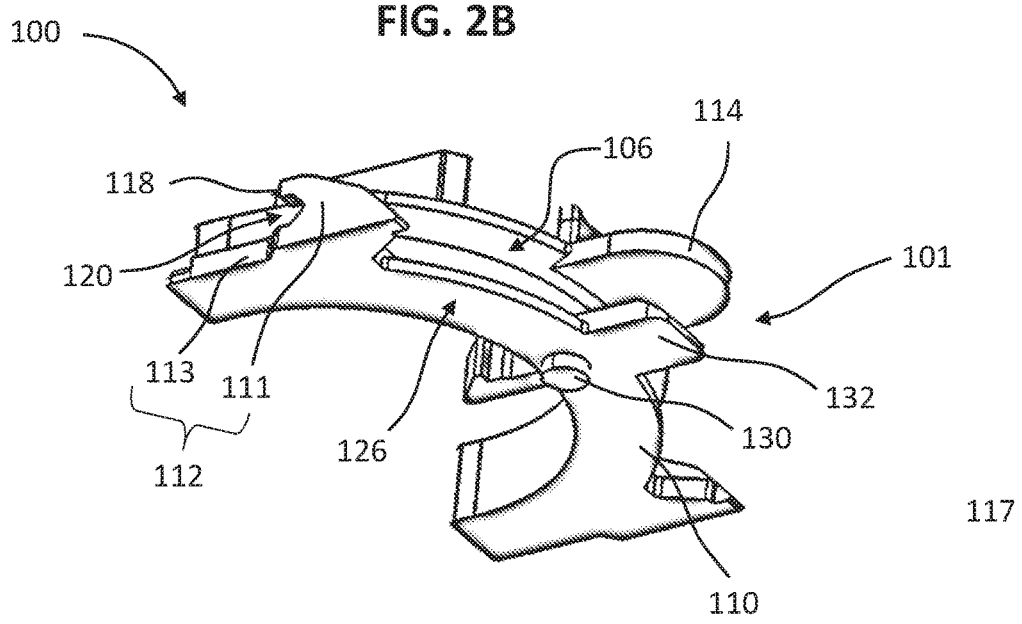
FIG. 2B shows a perspective view of a bottom surface in the cable guide of FIG. 1.

FIGS. 2A and 2B illustrate the cable guide 100 for redirecting the cable 22 in the window regulator assembly 10. The cable guide 100 is generally formed with an arc-shaped body 102 having an outer perimeter 104 and a cable guide groove 106 on the outer perimeter 104. For example, as shown in FIGS. 2A and 2B, the outer perimeter 104 of the arc-shaped body 102 includes an upper flange 108 and a lower flange 110 such that the cable guide groove 106 is formed between the upper and lower flanges 108 and 110. In FIGS. 2A and 2B, the cable guide 100 is configured to guide the cable 22 inside the cable guide groove 106 for redirecting the cable 22 such that the cable 22 wraps around the outer perimeter 104 of the cable guide 100 and smoothly travels inside the cable guide groove 106 of the cable guide 100 during the operation of the window regulator assembly 10.

As shown in FIGS. 2A and 2B, the cable guide 100 includes a pair of side hooks 112 and a cable holding tab 114. The cable holding tab 114 extends outward from a middle section 101 of the arc-shaped body 102 along the longitudinal axis X of the guide rail and the pair of side hooks 112 extends from end portions 103 of the arc-shaped body 102 in a transverse direction Y of the guide rails 14 and 16 relative to the longitudinal direction X. Each of the side hooks 112 is formed with a L-shaped body having an upper portion 111 and a lower portion 113. The lower portion 113 of the side hooks 112 extends from the end portion 103 of the cable guide 100 along the transverse axis Y and the upper portion 111 is angled upwardly from the lower portion 113 along a vertical axis Z of the guide rail 14 and 16.

As shown in FIG. 2A, for example, the upper portion 111 is angled with 90 degrees from the extended lower portion 113 of the side hooks. According to other forms of the present disclosure, however, the upper portion 111 may be angled with different angles from the extended lower portion 113. In FIGS. 2A and 2B, furthermore, the upper portion 111 of the side hook 112 is formed with a fin-shaped plane, which is parallel to an X-Z plane of the guide rail 14. The fin-shaped plane has a sloped edge 116, which moves upwardly toward a rear side 117 from a front side 115 of the side hook 112 along the longitudinal axis X. The rear side 117 of the fin-shaped plane is formed with a vertical edge 118 having a recess 120.

In FIG. 2A, the cable guide 100 further includes a pair of retention members 122 formed with a cantilever beam shape for mounting to the cable receiving site 200. The pair of retention members 122 extend toward an opposite side of the outwardly extended cable holding tab 114 along the longitudinal axis X of the guide rail 14. As shown in FIG. 2A, the retention member 122 includes a first end 121 attached to a top surface 124 of the upper flange 108 of the cable guide 100 and a second end 123 extending from the first end 121 and being engaged with a cable guide interface 202 protruding from the surface of the cable guide receiving site 200 (see FIG. 3). In addition, the cable guide 100 includes a push tab 128, which protrudes from the top surface 124 of the upper flange 108 in the middle section 101 of the arc-shaped body 102 along the vertical axis Z of the guide rail 14 for being used when the cable guide 100 is slidably installed in the cable guide receiving site 200 along the longitudinal axis X of the guide rail 14.

As shown in FIG. 2B, the cable guide 100 includes a protrusion 130 formed on the lower flange 110 of the cable guide 100. The protrusion 130 protrudes from a bottom surface 126 of the lower flange 110 in the middle section 101 of the arc-shaped body 102. Accordingly, when the cable guide 100 is slidably installed in the cable receiving site 200, the protrusion 130 is move in a guiding channel 206 formed on the cable guide receiving site 200 of the guide rails 14 and 16 for engaging with the cable guide interface 102 (See FIG. 3). In addition, the cable guide 100 includes a lower tab 132 extending outward from the lower flange 110 in the middle section 101 of the arc-shaped body 102 along the longitudinal axis X such that, when the cable 22 is placed in the installed cable guide 100, the cable 22 is located between the cable holding tab 114 extending from the upper flange 108 and the lower tab 132 extending from the lower flange 110 in the cable guide 100 before fully tensioned inside the cable guide groove 106.

Figure 3:
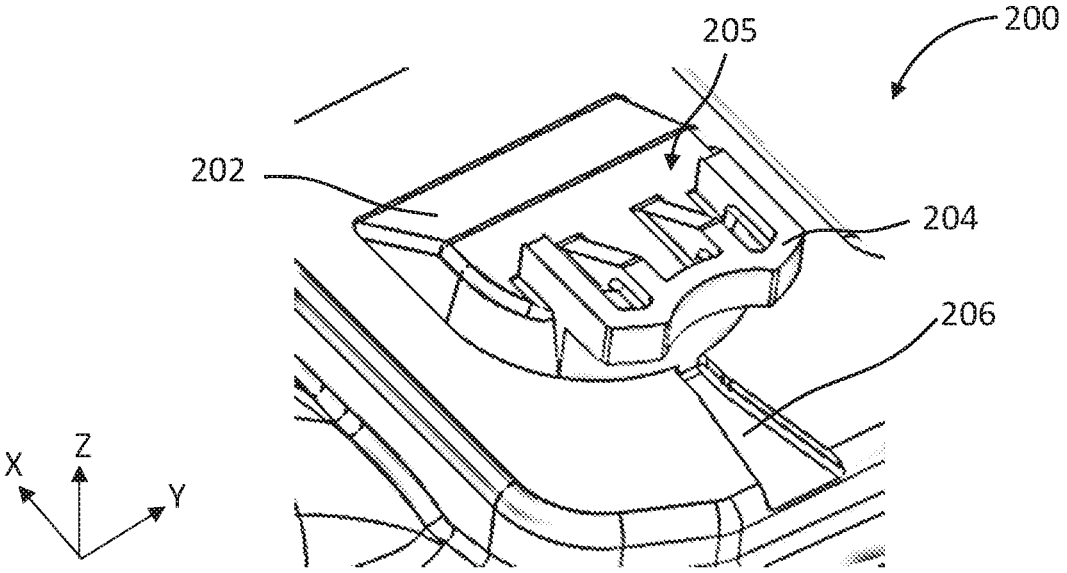
FIG. 3 shows a perspective view of a cable guide receiving site of a guide rail of FIG. 1.

FIG. 3 illustrates the cable guide receiving site 200 on one of the guide rails 14 and 16 in the integrated door module plate 20 for mounting the cable guide 100. The cable guide receiving site 200 includes a cable guide interface 202 formed to protrude from each of the guide rails 14 and 16 along the vertical axis Z and adapted to receive and mount the cable guide 100. The cable guide interface 202 of the cable guide receiving site 200 includes a cable guide retention tab 204 for retaining and securing the cable guide 100. The cable guide retention tab 204 is formed to extend from an upper face 205 of the cable guide interface 202 for engaging with the cable guide 100 along the longitudinal axis X such that the extended cable guide retention tab 204 is securely coupled with the top surface 124 of the cable guide 100 when the cable guide 100 is slidably mounted to the cable guide interface 202. In FIG. 3, the cable guide receiving site 200 further includes the guiding channel 206 for receiving and slidably guiding the protrusion 130 of the cable guide 100 along the longitudinal axis X when the cable guide is slidably mounted to the cable guide receiving site 200.

Figure 4:
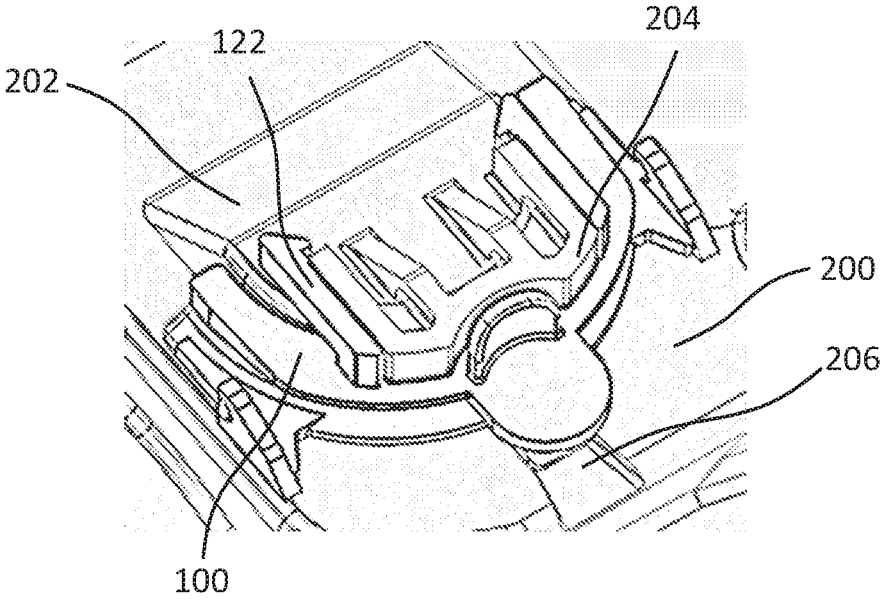
FIG. 4 shows a pre-installed state of a cable in the cable guide assembly of FIG. 1.

FIG. 4 shows the cable guide 100 slidably engaged with the cable guide interface 202 and securely mounted to the cable guide receiving site 200 to define a pre-installed state of the cable 22. In the pre-installed state of the cable 22, the cable guide retention tab 204 is coupled with the cable guide 100 when the protrusion 130 of the cable guide 100 is slidably engaged inside the guiding channel 206 of the cable guide receiving site 200, and the retention member 122 of the cable guide 100 is securely engaged with the cable guide retention tab 204 of the cable guide interface 102 such that the cable guide 100 is non-rotatably held on the cable guide receiving site 200 before installing the cable 22.

Figure 5:
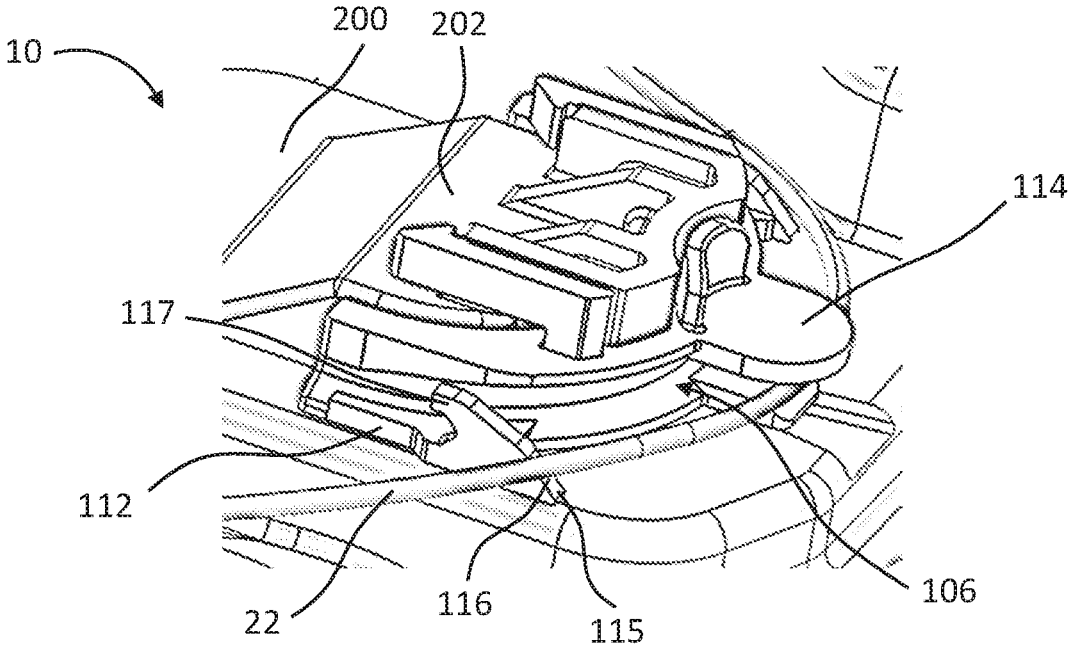
FIG. 5 shows an intermediate-installed state of the cable in the cable guide assembly of FIG. 1.

FIG. 5 shows the cable 22, which is a relaxed condition to define an intermediate-installed state of the cable 22. The relaxed condition of the cable 22 occurs during the assembly of the window regulator 12. In the intermediate-installed state of the cable 22, the cable 22 is set under the cable holding tab 114 of the cable guide 100 such that the cable 22 sits on a portion of the sloped edge 116 in the extended side hooks 112. After that, the cable 22 is pulled to install in the engaged cable guide 100 so that the cable 22 is slid towards the rear side 117 from the front side 115 along the sloped edge 116 of each of the side hooks 112 and the cable 22 is set to tension inside the cable guide groove 106 of the cable guide 100. Accordingly, the cable 22 is installed into the cable guide groove 106 and tensioned to engage with the cable guide 100, which is defined as a fully-installed state of the cable 22. Due to the side hooks 112 of the cable guide 100, the cable 22 is automatically set in a correct position during the installation of the cable 22 when the cable 22 is not set in the correct position such that the side hooks 112 formed in the cable guide 100 prevents the incorrect assembly of the cable 22, and also enables the easy assembly of the cable 22.

Figure 6:
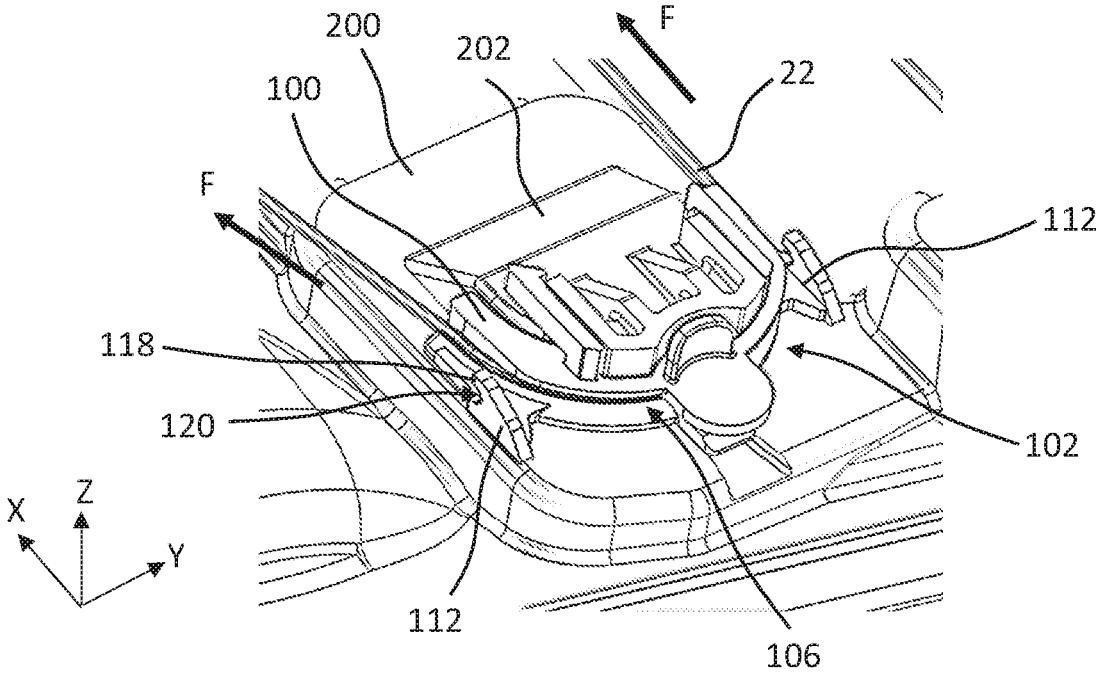
FIG. 6 shows a fully-installed state of the cable in the cable guide assembly of FIG. 1.

FIG. 6 shows the cable 22, which is a fully tensioned condition inside the cable guide groove 106 defined as the fully-installed state of the cable 22. In the fully-installed state of the cable 22, the cable 22 is properly set in the cable guide 100 mounted in the cable guide receiving site 200 and in operation. As shown in FIG. 6, a cable force F acts on the tensioned cable 22, which pulls the cable 22 extending in an X-Y plane into the cable guide groove 106 of the cable guide 100. Due to the installed cable guide 100 formed with the arc-shaped body 102 having a rounded and convexly curved shape, the tensioned cable 22 is redirected during the operation of the window regulator 10. In the fully-installed state of the cable 22 as shown in FIG. 6, the cable 22 is not come off from the cable guide 100 due to the side hooks 112 formed to extend from the cable guide 100. In addition, the recess 120 of the vertical edge 118 formed in the side hooks 112 of the cable guide 100 prevents the tensioned cable 22 from coming off from the cable guide 100. Accordingly, the side hooks 112 of the cable guide 100 prevents the cable 22 from coming off during the assembly process of the window regulator 10 and also in a vehicle condition.

While the above description constitutes the preferred embodiments of the present invention, it will be appreciated that the invention is susceptible to modification, variation and change without departing from the proper scope and fair meaning of the accompanying claims.

What is claimed is:

1. A cable guide assembly adapted for use with a guide rail for a motor vehicle, for redirecting a cable of a window regulator, the cable guide assembly comprising:

a cable guide formed with an arc-shaped body having a cable guide groove on an outer perimeter of the arc-shaped body and mounted to the guide rail, the cable guide including a pair of side hooks and a cable holding tab; and a cable guide receiving site formed to the guide rail adapted to receive and mount the cable guide, wherein the cable holding tab extends outward from a middle section of the arc-shaped body along a longitudinal axis of the guide rail and the cable is set under the cable holding tab defined in an intermediate-installed state of the cable, and wherein each of the side hooks extends from an end portion of the arc-shaped body along a transverse axis of the guide rail relative to the longitudinal axis and is configured to prevent the cable from coming off from the cable guide in a fully-installed state of the cable where the cable is set under tension in the cable guide.

2. The cable guide assembly of claim 1, wherein each of the side hooks is formed with a L-shaped body.

3. The cable guide assembly of claim 2, wherein the L-shaped body of the side hook includes a lower portion extending from the cable guide along the transverse axis and an upper portion upwardly angled from the lower portion in a vertical axis of the guide rail.

4. The cable guide assembly of claim 3, wherein the upper portion is formed with a fin-shaped plane parallel to a XZ-plane of the guide rail, and the fin-shaped plane includes a sloped-edge in a front side of the fin-shaped plane and a vertical-edge with a recess in a rear side of the fin-shaped plane.

5. The cable guide assembly of claim 4, wherein the cable set under the cable holding tab in the intermediate-installed state of the cable sits on the sloped edge of the fin-shaped plane and is slid to move inside the cable guide groove such that the cable is set under tension inside the cable guide groove in the fully-installed state of the cable.

6. The cable guide assembly of claim 5, wherein the side hooks of the cable guide are configured to prevent a tensioned cable in the fully-installed state from coming off the cable guide groove.

7. The cable guide assembly of claim 1, wherein the cable guide receiving site includes a cable guide interface formed with a cable guide retention tab for securing the cable guide.

8. The cable guide assembly of claim 7, wherein the cable guide includes a pair of retention members having a first end attached to an upper flange of the cable guide, and a second end extending from the first end along the longitudinal axis and being engaged with the cable guide retention tab.

9. The cable guide assembly of claim 1, wherein the cable guide receiving site includes a guiding channel formed on the guide rail along the longitudinal axis of the guide rail.

10. The cable guide assembly of claim 9, wherein the cable guide includes a protrusion formed on a bottom surface of the arc-shaped body for slidably engaging with the guide channel when the cable guide is securely mounted to the cable guide receiving site defined as a pre-installed state of the cable.

11. The cable guide assembly of claim 1, wherein the cable guide includes an upper flange and a lower flange, and the cable guide groove formed on the outer perimeter of the arc-shaped body is located between the upper flange and the lower flange.

12. The cable guide assembly of claim 11, wherein a lower portion of a L-shaped side hook extends from the lower flange of the arc-shaped body along the transverse axis, and the cable holding tab extends from the upper flange of the arc-shaped body along the longitudinal axis.

* * * * *